United States Patent [19]

Doane

[11] 4,226,062

[45] Oct. 7, 1980

[54] MOLDED STORAGE RECEPTABLE

[76] Inventor: Elbert E. Doane, 4961 SW. 17th St., Fort Lauderdale, Fla. 33517

[21] Appl. No.: 925,000

[22] Filed: Jul. 17, 1978

[51] Int. Cl.[2] ..... E04F 11/00

[52] U.S. Cl. ..... 52/169.6; 52/107; 52/186

[58] Field of Search ..... 52/169.6, 107, 182, 52/186

[56] References Cited

U.S. PATENT DOCUMENTS

| | | | |
|---|---|---|---|
| 984,942 | 2/1911 | Leddy | 52/169.6 X |
| 2,936,504 | 5/1960 | Harris | 52/169.6 |
| 3,173,387 | 3/1965 | Cree | 52/169.6 X |
| 3,738,070 | 6/1973 | Yarbrough | 52/169.6 X |

*Primary Examiner*—William F. Pate, III

*Attorney, Agent, or Firm*—Barry L. Haley; Eugene F. Malin; Philip R. Wadsworth

[57] ABSTRACT

A molded storage receptable that is disposed in the ground having a sealed, removeable cover that provides for a variety of uses including subterranean water or article storage or a mechanic's working pit. The device includes a molded fiberglass shell having a plurality of integrally molded, lateral reinforcing ribs disposed along the vertical sides and bottom of the fiberglass shell, and at least one molded stairwell disposed at one end of said shell which includes a plurality of molded stairs to allow ingress or egress into or out of the storage receptacle. The shell is premolded and shipped to a site in which the earth is removed and the shell disposed within the hole in the earth. Integrally molded upper laterial flanges can be used to tie down the receptacle to prevent pop up in the event of total water levels. The cover may include rollers for opening or closing movement relative to the receptacle or hinges at one end used in conjunction with a hydraulic piston to raise or lower the cover.

2 Claims, 5 Drawing Figures

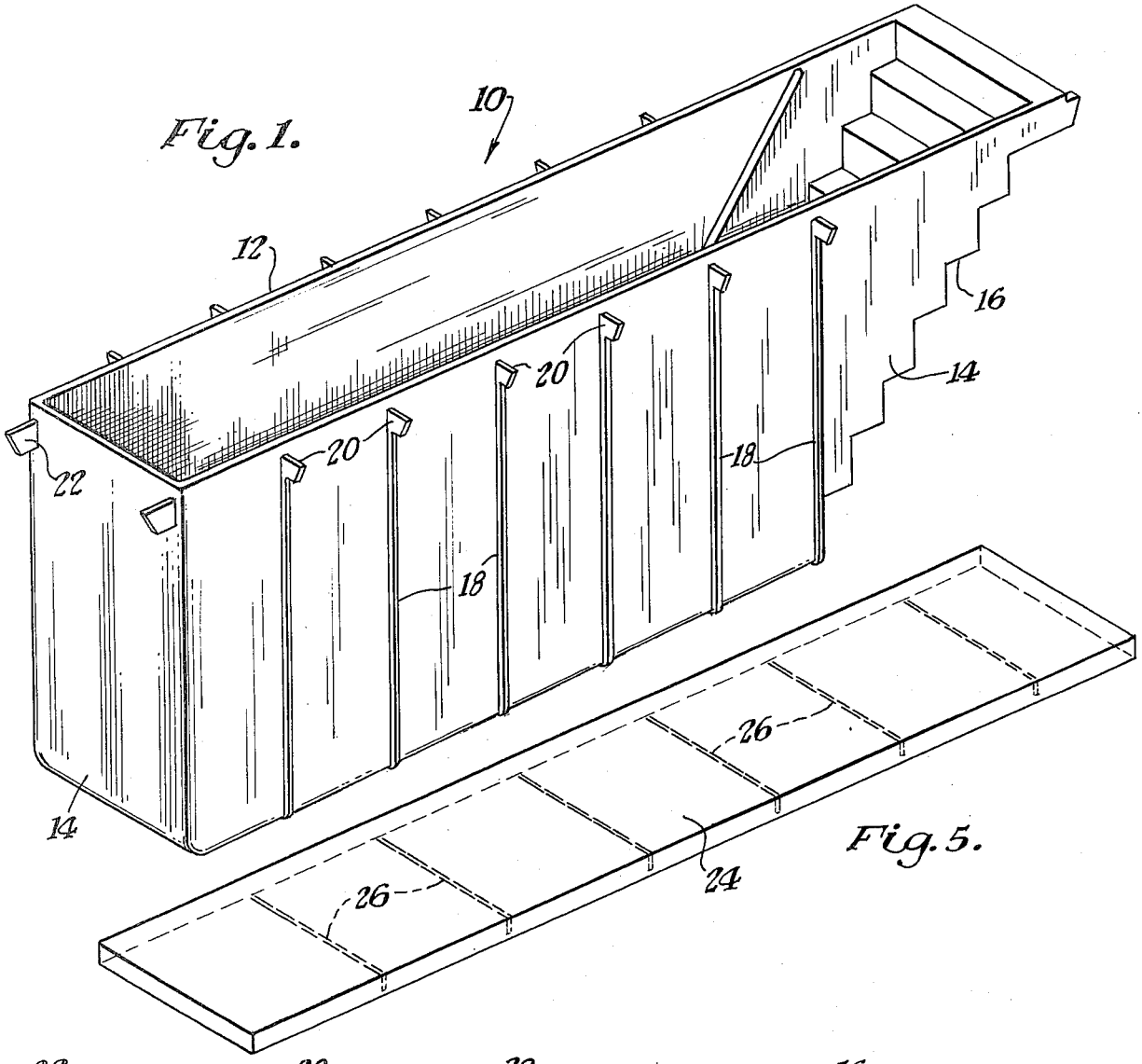
Fig. 1.
Fig. 5.
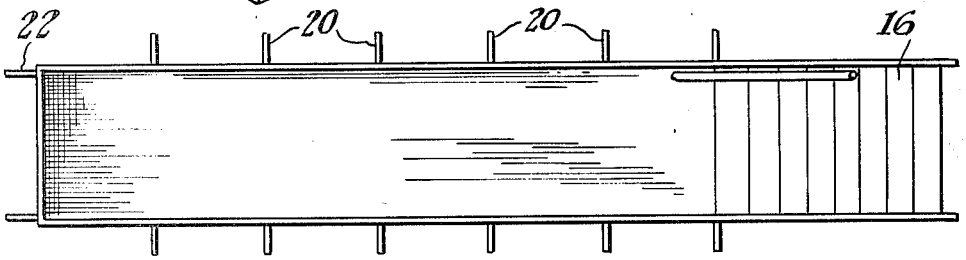
Fig. 2.
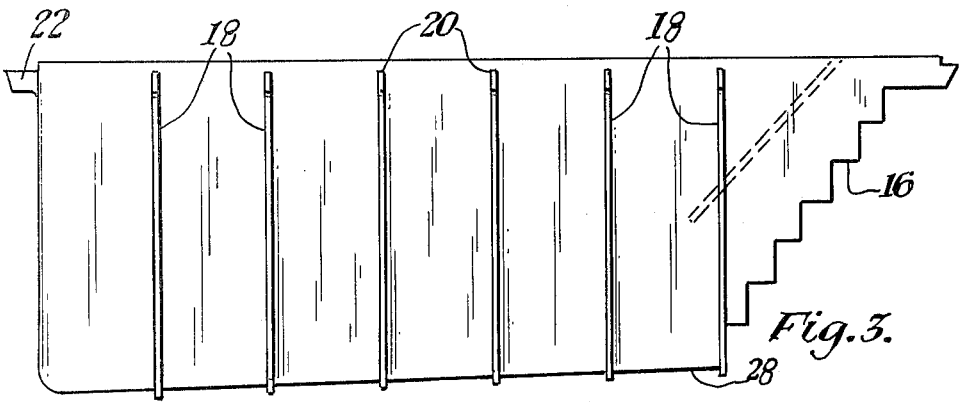
Fig. 3.
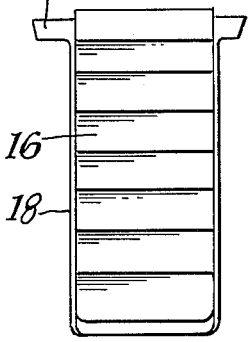
Fig. 4.

MOLDED STORAGE RECEPTABLE

BACKGROUND OF THE INVENTION

This invention relates generally to a receptacle which is diposed in a subterranean environment having molded integral sides and a bottom, with an open top and includes a removable sealable cover which may be mounted over the receptacle opening, sealing it from the outside environment.

In recent years with the accumulation of material goods, the average household has found it necessary to seek additional convenient storage areas. It is not uncommon today for people to rent storage space or warehouses or to erect aluminum or similar type storage sheds behind their homes in their yards. These storage sheds take up additional yard space, require pouring of a concrete foundation or the like and in general detract from the asthetic appearance of a yard or other environment.

The present invention overcomes the problems found in the prior storage devices such as storage sheds by providing integrally molded subterranean storage receptacles which may be readily constructed and transported to a particular location and simply mounted within a hole in the earth. The present invention includes a removeable closure which seals the inside of the storage receptacle and provides for safe walking across the receptacle when it is not opened. The device is also shaped for utilization with a vehicle as a mechanic's pit in which the vehicle may be partially disposed over the receptacle with the cover removed allowing one to stand in the pit and service the vehicle from beneath. The device may also be used to store water.

BRIEF DESCRIPTION OF THE INVENTION

This invention is for a subterranean, molded storage receptacle comprising an elongated, molded fiberglass shell, said fibergass shell including four sides and a bottom, one of the insides including a molded stairwell disposed from the top edge to the bottom surface, the top of the shell being opened. The shell structure includes one or more vertically disposed, integrally formed ribs disposed along the sides and the base exterior of the shell which allows for increased strength of construction. The device further includes elongated flanges disposed along the top of the shell projecting laterally outwardly which allow the shell to be tied down securely to prevent pop-up resulting from a local water level above the bottom of the shell.

A removable cover is elongated and rectangular in shape in one embodiment and fits with a gasket in a sealable relationship over the top of the shell such that it is slightly raised relative to the flanges disposed along the top laterally. The flanges permit the top cover to snuggly rest on top of the shell. The cover could include a plurality of rollers to permit movement relative to the shell for opening or closing. In another embodiment, the cover has hinges at one end and uses a hydraulic piston for raising or lowering.

The shell is molded of a fiberglass or other suitable plastic material with the ribs integrally formed for increased strength of the device. In the construction of the device, the shell is molded of fiberglass or similar plastic using conventional techniques.

Stairs which may be molded at one or both ends of the shell are constructed when the entire shell is molded. A hand rail may be included and coupled on the inside wall paralling the stairs to allow one to safely move in or out of the storage well.

In the preferred embodiment, the storage well may be approximately 16 feet in length and approximately 2½ feet in width and approximately 5½ feet in height. This provides a size that allows an average sized person to stand within the device and reach upwardly to use the device as a mechanic's pit, with a vehicle width between the wheels being greater than the lateral width of the storage shell.

In operation, the removeable closure or cover is removed, allowing access into the storage well. The party wishing to enter would simply proceed down the stairs and may walk along the shell bottom. When the area is to be sealed, the cover is merely placed over the top of the shell opening, allowing the cover to be walked on or the like, completely hiding the storage area from the surrounding view. Shelves could be mounted on the interior walls. A water pumping system may be used to remove excess water from the receptacle or remove stored water therein.

It is an object of this invention to provide an improved storage receptacle that is prefabricated from molded fiberglass or the like.

It is another object of this invention to provide an improved storage receptacle that is subterranean mounted and includes a removeable but sealable closure at ground level.

And yet, still another object of this invention is to provide a subterranean receptacle having a variety of uses such as a storage receptacle or a prefabricated mechanic's pit, the device allowing ingress or egress through premolded stairs disposed at one end.

And yet, still another object of this invention is to provide an improved prefabricated storage receptacle that eliminates pouring of slabs or vertical elevated structures disposed in a yard area by providing for subterranean storage.

In accordance with these and other objects which will be apparent hereinafter, the instant invention will now be described with particular reference to the accompanying drawings.

BRIEF DESCRIPTION OF THE DRAWINGS

FIG. 1 shows a perspective view of the instant invention.

FIG. 2 shows a top plan view of the instant invention with the cover removed.

FIG. 3 shows a side elevational view of the storage shell utilized in the instant invention.

FIG. 4 shows an end elevational view of the instant invention.

FIG. 5 shows a perspective view of the cover.

PREFERRED EMBODIMENT OF THE INVENTION

Referring now to the drawings and particularly FIG. 1, the storage receptacle of the instant invention is shown generally at 10 with the cover removed comprised of a prefabricated, integrally-molded, rectangularly shaped shell 12 having vertical side walls 14 molded integrally with vertical end wall 14 at one end and an integrally molded stairwell 16. A stairwell may be included at one or both ends of the shell. The device includes a bottom surface, all of the sides and bottom including the stairwell being formed in fiberglass or a suitable rigid plastic in a single molding operation.

The shell 12 includes a plurality of integrally molded vertical support ribs 18 for increased rigid support for compression and torsional forces acting on the side walls. The supporting ribs 18 are connected to flanges 20 which extend laterally away from the exterior surface of the shell near the opening that receives earch mounted tie downs (not shown) to secure the receptacle to the earth, preventing pop-up. Additional flanges 22 are disposed at each end for increased strength and for tie down. The ribs 18 are continued along the bottom surface of the device for overall structural rigidity.

Referring now to FIG. 5, the removeable cover 24, which is substantially molded fiberglass having lateral ribs 26 is sized to fit over the receptacle opening as shown in FIG. 1 and to be substantially in the plane of the top of the earth, when the device is closed. The cover may include a gasket seal to more properly prevent water or other elements from being received into the receptacle when closed.

The device is sized in length, width, and height to also allow its use as a mechanic's pit such that the height is slightly over 5 feet while the lateral width is 2½ feet which allows the wheels of a vehicle to be disposed such that the vehicle wheels may straddle the pit so that a person can stand down in the pit and have access to the underside of a vehicle for mechanical work and the like.

FIG. 3 shows the storage shell including the ribs 18 disposed along the bottom surface 28 and including the premolded stairs 16.

FIG. 2 shows the projecting flanges 20 and 22 connected to the various sides of the storage receptacle.

FIG. 4 shows an end view in which the device may be mounted in the ground with the flanges received in the ground or in a slab adjacent thereto. The cover is mounted as shown, such that in the closed position, the cover is essentially parallel to the slab or the ground. The molding of the ribs 20 may be on the interior instead of the exterior walls.

The instant invention has been shown and described herein in what is considered to be the most practical and preferred embodiment. It is recognized, however, that departures may be made therefrom within the scope of the invention and that obvious modifications will occur to a person skilled in the art. 9n

What I claim is:

1. A prefabricated fiberglass receptacle which is mounted in the earth for use as a subterranean storage area or vehicle mechanical pit, comprising:

a molded, substantially rectangular shell, said shell having molded integrally a plurality of vertical sides, an end wall, and a bottom surface, said shell including a premolded stairway access at one end extending from the bottom surface to the top edge, the shell being open across the top;

a plurality of U-shaped ribs, each of said ribs being disposed vertically on the side walls and spaced apart and continuing across the bottom surface on the exterior, said ribs being used for increasing the structural rigidity of the shell;

a plurality of laterally, outwardly extending flanges disposed around the top of the shell opening but below said shell opening for engagement with the earth, said laterally disposed flanges being formed with said ribs, said shell being mountable within a cavity in the earth such that the upper open portion is substantially ground level while the laterally disposed flanges are within the earth's surface; and an elongated, substantially flat fiberglass prefabricated molded cover mountable on the top of said storage shell to provide a sealed relationship covering said shell, said cover being disposed at ground level.

2. A device as in claim 1, including:

said lateral width being sized to be smaller than the distance between the wheels of a conventional vehicle for utilizing as a mechanic's pit, the height of the receptacle being such as to accommodate an average sized person to allow standing within the receptacle to work on a vehicle disposed above the device.

* * * * *

UNITED STATES PATENT OFFICE

CERTIFICATE OF CORRECTION

PATENT NO. : 4,226,062

DATED : October 7, 1980

INVENTOR(S) : Elbert E. Doane

It is certified that error appears in the above-identified patent and that said Letters Patent are hereby corrected as shown below:

Change Inventor's zip code from "33517" to --33317--.

Signed and Sealed this

*Third* Day of *March 1981*

[SEAL]

*Attest:*

RENE D. TEGTMEYER

*Attesting Officer*

*Acting Commissioner of Patents and Trademarks*